United States Patent [19]

Gerke et al.

[11] Patent Number: 4,822,298

[45] Date of Patent: Apr. 18, 1989

[54] WIRE CONNECTION FOR CABLE WIRES

[75] Inventors: Dieter Gerke; Manfred Müller; Lutz Biederstedt, all of Berlin, Fed. Rep. of Germany

[73] Assignee: Krone Aktiengesellschaft, Fed. Rep. of Germany

[21] Appl. No.: 177,496

[22] Filed: Apr. 4, 1988

[30] Foreign Application Priority Data

Apr. 7, 1987 [DE] Fed. Rep. of Germany ..... 3711675

[51] Int. Cl.[4] ..... H01R 4/24

[52] U.S. Cl. ..... 439/402; 439/417

[58] Field of Search ..... 439/389–426

[56] References Cited

U.S. PATENT DOCUMENTS 3,573,713 4/1971 Enright et al. ..... 439/402
3,890,029 6/1975 Inraeli ..... 439/402
3,899,236 8/1975 Santos ..... 439/402
4,023,883 5/1977 Raposa et al. ..... 439/402

*Primary Examiner*—Joseph H. McGlynn
*Attorney, Agent, or Firm*—McGlew & Tuttle

[57] ABSTRACT

The invention relates to a wire connector for cable wires, in particular for telecommunications.

A device is provided in a wire connector, which can be used for generating a connecting splice as well as for generating a branching splice, without special tools for cutting the cable wires off being necessary. Guide channels (4) are provided having a separating knife (6) for the cable wires (7,8). Furthermore, the upper part of housing (2) includes separating pieces on its underside. The upper part of housing (2) is latchable with the lower part of housing (1) in two different positions, the separating pieces cooperating in one position only with the separating knives (6).

20 Claims, 7 Drawing Sheets

WIRE CONNECTION FOR CABLE WIRES

FIELD AND BACKGROUND OF THE INVENTION

The invention relates to a wire connector for cable wires, in particular for telecommunications.

A wire connector of the mentioned species is known from German No. 23 28 505 A1. There, cutting/clamping contacts are inserted in the longitudinal center of the lower part of housing into two parallel guide channels. Further, two upper parts of housing are provided being connected to the lower part of housing over film hinges. The upper parts of housing when latching press the lower part of housing. The cable wires being inserted into the contact slots of the cutting/clamping contacts by means of the press-in pieces into the contact slots of the cutting/clamping contacts. In this way, either a connecting splice between two cable wires passing through the wire connector or a branching splice can be formed, in which only one cable wire passes through the wire ,connector, whereas the other cable wire has to be cut off outside the wire connector.

For producing a connecting splice from this branching splice, the other cable wire has, then, also to be cut off behind the cutting/clamping contact.

It is disadvantageous, here, that for cutting the cable

It is disadvantageous, here, that for cutting the cable wires off, special cutting tools are required and that there is a risk of short circuits when cutting-off the cable wire.

Another wire connector for telecommunication cables is known from German No. 32 00 213 A1, in which separating knives are assigned to the cutting/clamping contacts. When closing the wire connector by means of the upper part of housing, the cable wires are both pressed into the contact slots of the cutting/clamping contacts by press-in pieces and are cut off to length by means of the separating knives. It is disadvantageous, here, that both cable wires are cut off simultaneously, such that only one connecting splice can be formed.

SUMMARY AND OBJECT OF THE INVENTION

It is an object of the invention to provide a wire connector of the mentioned species which can be used for forming a connecting splice as well as for forming a branching splice, without the need of special tools for cutting the cable wires off.

According to the invention, an upper part of a housing is latchable in two different positions with the lower part of housing. With this construction it is possible to form both a connecting splice an a branching splice. This is accomplished as the separating pieces cooperate with the separating knives in only one position of the upper part of housing to form the connecting splice, and do not cooperate with the separating knives in the other position of the upper part of housing, such that the cable wires are not cut off in forming a branching splice.

For converting a branching splice into a connecting splice, an additional separating element is placed on the lower part of housing. This separating element is provided with separating pieces for separating the cable wires passing first through the wire connector. In this way, a conversion of the branching splice into a connecting splice is possible without using special tools.

A further object of the invention is to provide a wire connector for telecommunication cable wires which may be used for forming a connecting splice and for forming a branching splice which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DESCRIPTION OF THE PREFERRED EMBODIMENTS

Figure 1:
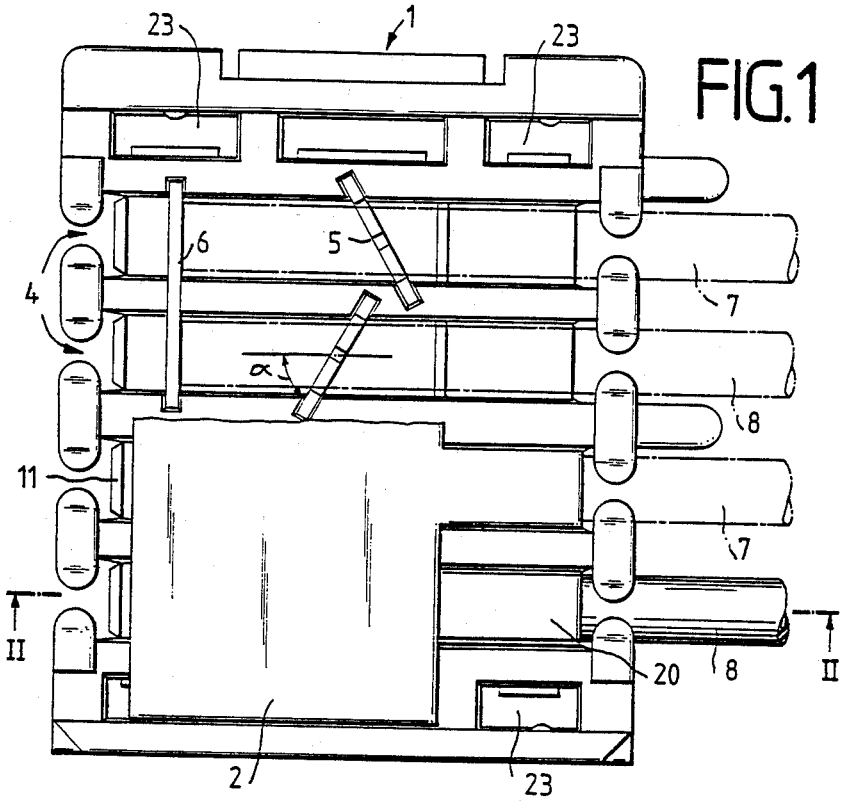
FIG. 1 is a partial broken top view of the first embodiment of the wire connector as a connecting splice.

Referring to the drawings in particular, the invention embodied therein includes a wire connector particularly for telecommunication cable wires including a lower housing part 1 which defines at least two guide channels 4 for the cable wires. An upper housing part 2 is provided which includes snap-in means for snap-in connection with the lower housing part 1. At least two cutting/clamping contacts 5 are provided, each inserted into respective corresponding guide channels 4 of the lower housing part 1. The clamping contacts are provided with contact slots having sides adapted to contact a wire within the wire insulation. Press-in pieces 12 are formed at the underside of the upper housing part 2 and cooperate with the contact slots of the cutting/clamping contact 5. Separating knives 6 are provided in each guide channel for separating the cable wires. The upper housing part includes separating means 14,16, 18; 74 at an underside portion of the upper housing part. The upper housing part is latchable in two different positions with respect to the lower housing part 1. The press-in pieces act to press the cable wires into the cutting/-clamping contact slots to make electrical contacts in each of the two latchable positions of the upper housing part. The separating means pushing the cable wire into a separating knife for separating the cable wires in only one latchable position of the upper housing part.

In the first embodiment according to FIGS. 1 to 7, the wire connector consists of a lower part of housing 1, an upper part of housing 2 latchable on said lower part of housing 1, and a separating element 3 also latchable on said lower part of housing 1, of cutting/clamping contacts 5 inserted into the guide channels 4 of the lower part of housing 1, and of separating knives 6. The lower part of housing 1, the upper part of housing 2, and the separating element 3 consist of plastic. The cutting/-clamping contacts 5 and the separating knives 6 consist of an electrically conductive, metal material.

Figure 4:
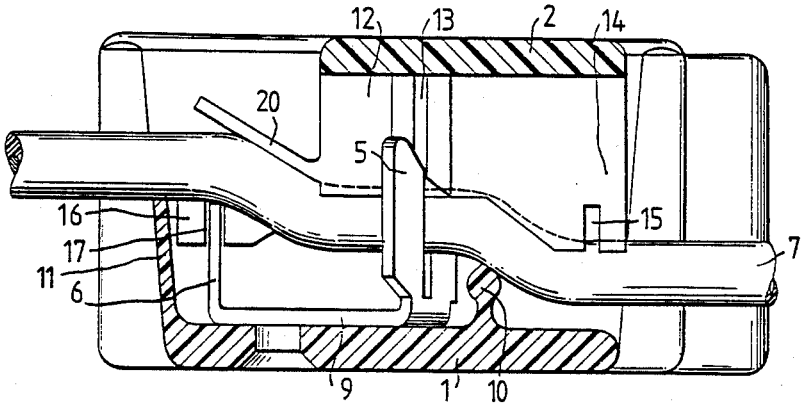
FIG. 4 is a longitudinal sectional view taken in the direction of line IV—IV in FIG. 3.

The lower part of housing comprises four adjacent guide channels 4 for introduction and connection of two pairs of cable wires 7,8. The cutting/clamping contacts 5 and the separating elements 6 arranged spaced to each other in a guide channel 4 are connected to each other over a crosspiece 9 (FIG. 4). In each guide channel 4, a support wall 10,11 each for the cable wires 7, 8 is formed before and behind the cutting/clamping contacts 5 or the separating knife 6, respectively. The cutting/clamping contacts 5 of two adjacent guide channels 4 are connected electrically conductively to each other.

The cutting/clamping contacts 5 are arranged under an angle alpha between 30° and 60°with respect to the longitudinal axis of the guide channels 4, two adjacent cutting/clamping contacts 5 being arranged under opposed angles alpha and staggered to each other in longitudinal direction of the guide channels 4.

The upper part of housing 2 is latchable in two different positions with respect to the lower part of housing 1; for this purpose, the upper part of housing 2 has to be turned by 180° by irs vertical axis with respect to the lower part of housing 1. The upper part of housing 2 is provided on its underside with press-in pieces 12 for the cable wires 7,8, the press-in pieces 12 extending in parallel to the guide channels 4. The press-in pieces 12 form cross slots 13 for the area of the cutting/clamping contacts 15. The cross slots 13 allow the penetration of the cutting/clamping contacts 5 under simultaneous pressing-in of the cable wires 7,8 into the contact slots of the cutting/clamping contacts 5. The press-in pieces 12 form with their extensions separating pieces 14 with separating slots 15, into which engage the separating knives 6.

Figure 2:
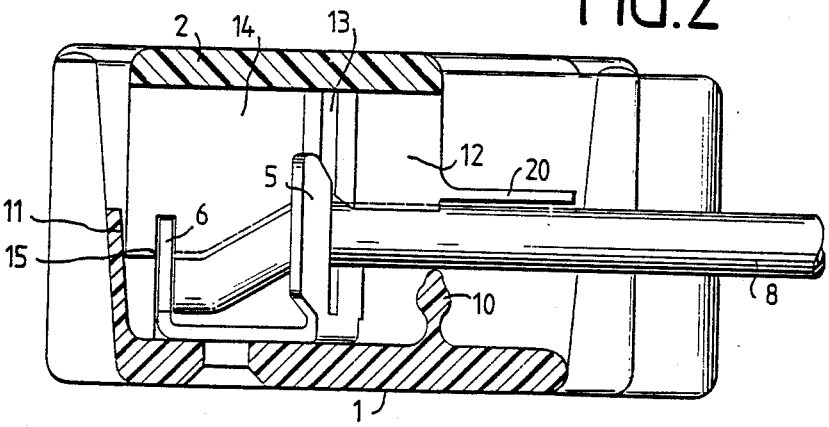
FIG. 2 is a longitudinal sectional view taken in the direction of line II—II in FIG. 1.

For forming the wire connector as connecting splice, the upper part of housing is snapped, according to FIGS. 1 and 2, on the lower part of housing 1 such that the separating slots 15 can accommodate the separating knives 6, and that the cross slots 13 can accommodate the cutting/clamping contacts 5. The cable wires 7, 8 to be connected are inserted into the guide channels 4 of the lower part of housing 1, and are, when pressing on and latching the upper part of housing 2 by means of the press-in pieces 12, pressed into contact slots of the cutting/clamping contacts 5, and are simultaneously cut-off by means of the separating pieces 14 at the separating knives 6, such that a connecting splice is formed between the pairs of cable wires 7, 8. The support walls 10 within the guide channels 4 are deformed during this action, as shown in FIG. 2.

Figure 3:
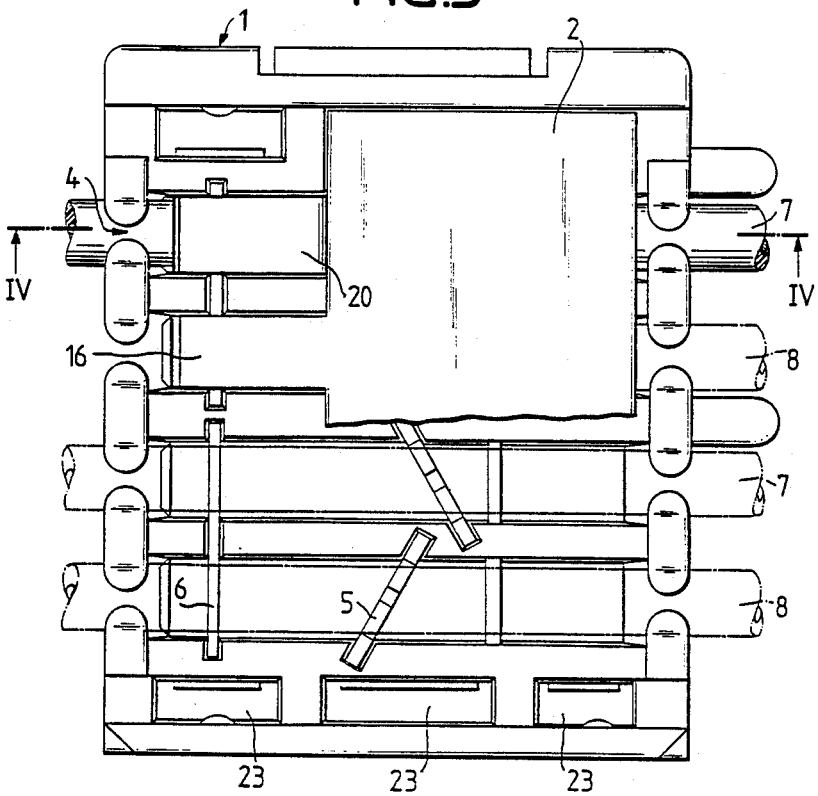
FIG. 3 is a partial broken top view of the first embodiment of the wire connector as a branching splice.

In FIGS. 3 and 4, the wire connector is shown in the first embodiment as branching splice. For this purpose, the upper part of housing 2 is latched with the lower part of housing 1 in a position turned by 180° by its vertical axis. As shown in FIG. 4, the separating pieces 14 do not come into engagement with the separating knives 6, but the separating pieces 14 do press only the cable wires 7, 8 into the lower part of housing 1. On the longitudinal side of the upper part of housing 2 opposite to the separating pieces 14 and separating slots 15, further separating pieces 16 with separating slots 17 formed as one piece with the upper part of housing 1 are provided for every second guide channel 4, said separating pieces 16 coming into engagement with every second cable wire 7,8 and cutting them off. For the two other cable wires 7,8, elastic lugs 20 only are shaped at the upper part of housing 2, said lugs 20 just holding the cable wires in the lower part of housing 1, without being capable, however, to press the cable wires 7,8 against the separating knives 6. Thus, only the cable wires 8 are cut off by means of the additional separating pieces 16, whereas the cable wires 7 are passed through the wire connector without being separated. Thus results a branching splice between the passed through cable wire 7 and the cut-off cable wire 8 being electrically connected to the cable wire 7.

Figure 5:
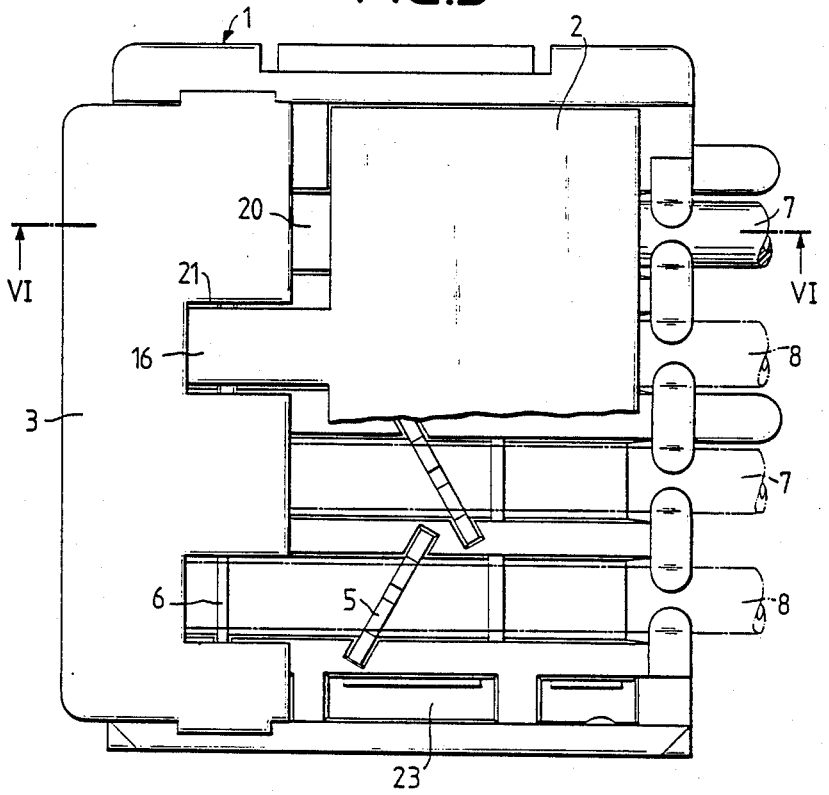
FIG. 5 is a partial broken top view of the wire connector in the first embodiment as branching splice converted in to a connecting splice by means of a separating element.
Figure 6:
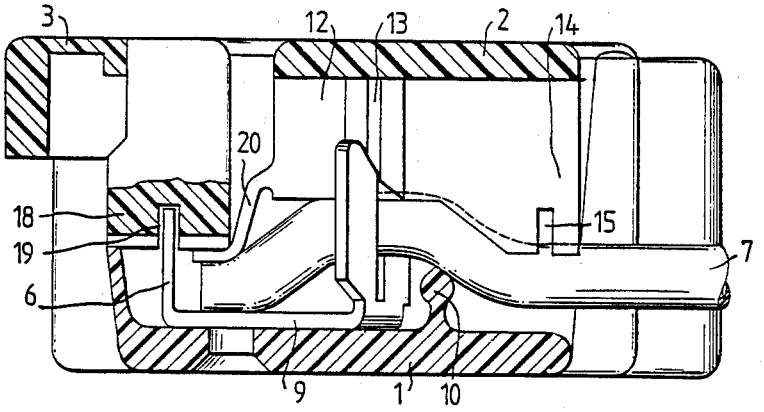
FIG. 6 is a longitudinal sectional view taken in the direction of line VI—VI in FIG. 5.

FIG. 5 and 6 show the conversion of the branching splice according to FIGS. 3 and 4 into a connecting splice. For this purpose, the separating element 3 is, in addition to the upper part of housing 2, snapped on the lower part of housing 1. The separating element exhibits additional separating pieces 18 with separating slots 19 and cuts 21 between the separating pieces 18, into which penetrate the additional separating pieces 16 of the upper part of housing 2. By means of the additional separating pieces 18 of the separating element 3, now the cable wires 7 are cut off, too, the separating pieces 18 engaging with their separating slots 19 over the separating knives 6, as shown in FIG. 6. It results a connecting splice between the respective adjacent cable wires 7 and 8.

Figure 7:
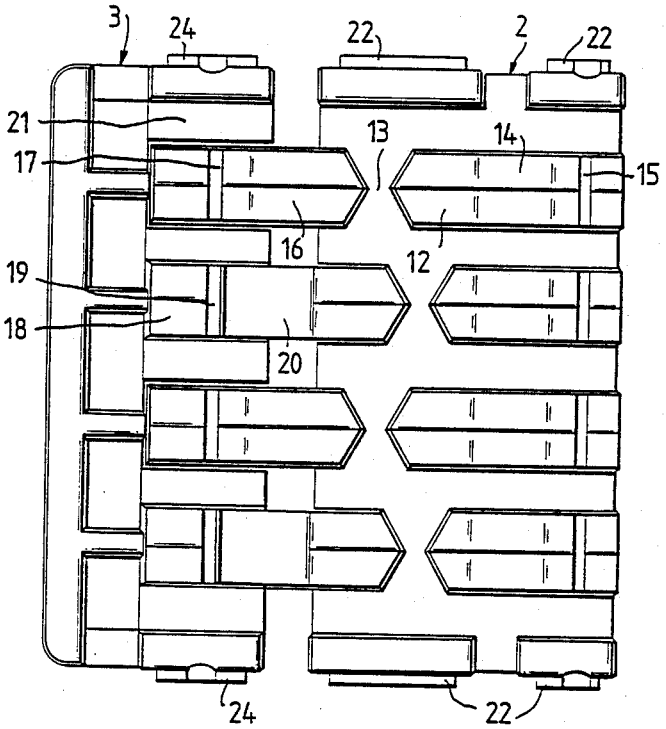
FIG. 7 is bottom view of the upper part of a housing and of the separating element in the first embodiment.

FIG. 7 shows a bottom view of the upper part of housing 2 and the separating element 3 of the wire connector. Approximately in the center of the combination of upper part of housing 2 and separating element 3 being in operational position, the alternatively staggered cross slots 13 are disposed, into which penetrate the cutting/clamping connecting elements 5. In FIG. 7, on the right-hand side of the press-in pieces 12, the separating pieces 14 with the separating slots 15 are disposed, and on the left-hand side of the press-in pieces 12, the separating pieces 16 with the separating slots 17 are disposed. The two additional separating pieces 16 are accommodated by the cuts 21 of the separating element 3. The respective lugs 20 arranged at the upper part of housing 2 alternatively to the additional separating pieces 16 of the upper part of housing 2 cover the separating pieces 18 with the separating slots 19 of the separating element 3. As shown in FIG. 6, the lugs 20 are driven away by the separating pieces 18 of the separating element 3, such that the separating slots 19 of the separating pieces 18 can come into operational connection with the separating knives 6.

The upper part of housing 2 exhibits at its two narrow sides two snap-in pieces 22 each, capable to engage into correspondingly adapted snap-in slots 23 of the lower part of housing 1 and latching there. Correspondingly, the separating element 3 exhibits on both narrow sides one snap-in piece 24 each engaging, too, into the snap-in slots 23 of the lower part of housing 1 in latching manner.

Figure 8:
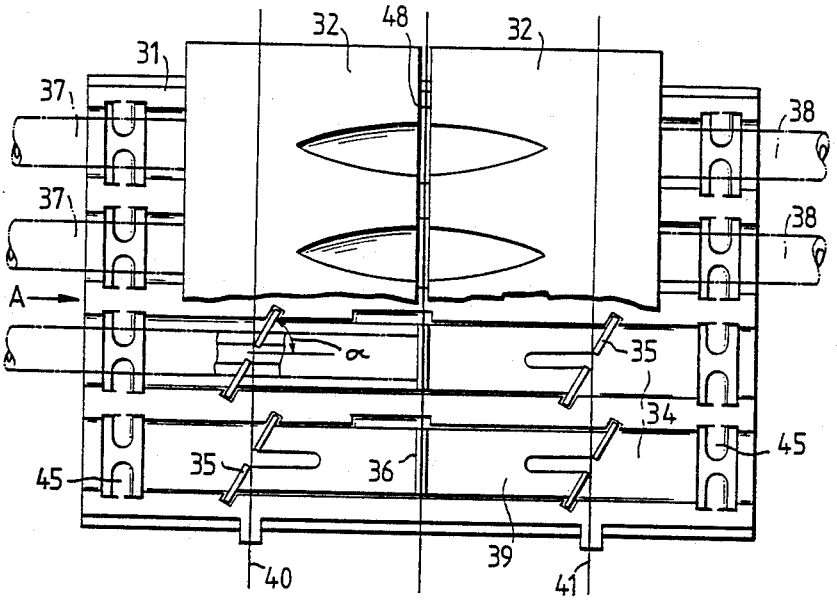
FIG. 8 is a partial broken top view of the second embodiment of the wire connector as connecting splice.
Figure 9:
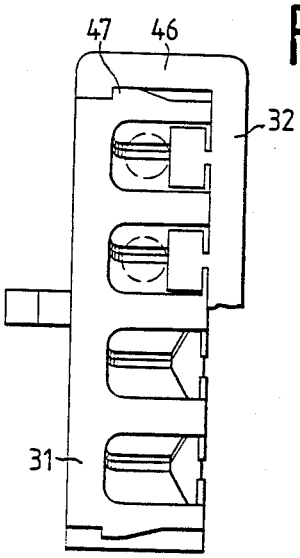
FIG. 9 is a view taken in the direction of arrow A in FIG. 8.
Figure 10:
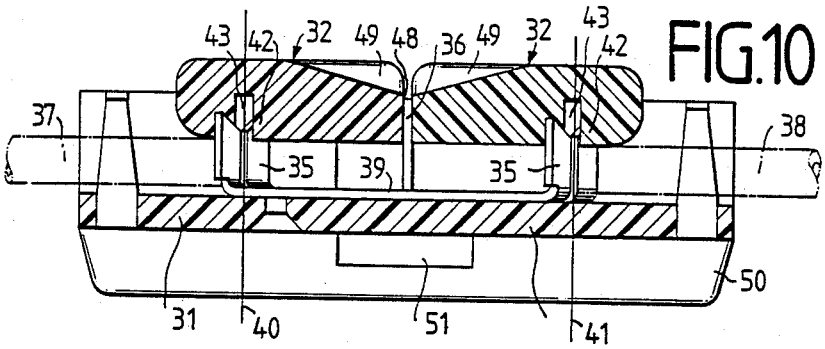
FIG. 10 is a longitudinal sectional view through the wire connector forming a connecting splice according to FIG. 8.

The second embodiment of the wire connector is shown in FIGS. 8 to 10. It consists of a lower part of housing 31 and two identical upper parts of housing 32 latchable with the lower part of housing 31, and of a separating element 33 latchable with the lower part of housing 31. The lower part of housing 31, the upper parts of housing 32 and the separating element 33 consist of plastic. In the lower part of housing 31, four rectilinearly passing groove-type guide channels 34 for cable wires 37,38 are provided. To the guide channels 34, tongues 45 at the narrow sides of the lower part of housing 31 for holding the cable wires 37,38 inserted into the guide channels 34 are assigned.

In the center area of the rectilinearly passing groove-type guide channels 34, two cutting/clamping contacts 35 each are inserted in two parallel rows 40, 41, the connecting crosspieces 39 of which forming separating knives 36 in the longitudinal center of the guide channels 34. The cutting/clamping contacts 35 arranged under angles alpha between 30° and 60° with respect to the longitudinal axis of the guide channels 34 are formed by two legs, between which the actual contact slot extends. Both legs are supported in the side walls of the guide channels 34. The separating knives 36 are formed by lugs extending rectangularly from the connecting cross-pieces 39. The two cutting/clamping contacts 35 of each two 40, 41, the centrally disposed separating knife 36 and the connecting crosspieces 39 are, thus, formed as one piece of metal, electrically conductive material. The row of separating knives 36 is, then, disposed accurately centrally between the rows 40, 41 of cutting/clamping contacts 35.

In its cross-section, each upper part of housing 32 is approximately U-shaped and latchable by means of snap-in hooks 46 behind latches 47 on the lower part of housing 31. On its inner side, each upper part of housing 32 exhibits press-in pieces 42 with cross slots 43, into which the cutting/clamping contacts 35 can penetrate when snapping the upper part of housing 32 on. The press-in pieces 42 disposed on both sides of the cross slots 43 press on the cable wires 37, 38, in order to press them into the contact slots of the cutting/clamping contacts 35. One longitudinal side wall of each upper part of housing 32 forms a shear-off edge 48, which may rest against the separating knives 36. Thus, the distance between the longitudinal side wall of the upper parts of housing 32 forming the shear-off edge 48 and the center of the cross slots 43 for accommodation of the cutting/-clamping contacts 35 of each upper part of housing 32 is identical to the distance of the row of separating knives 36 to the two rows 40, 41 of the cutting/clamping contacts 35. The distance of the other longitudinal side walls of each upper part of housing 32 to the cross slots 43 is considerably smaller.

Each upper part of housing 32 exhibits further on its upper side grooves 49 extending obliquely to the longitudinal side wall provided with the shear-off edge 48 for guiding branched cable wires 37, 38. Further, on the underside of the lower part of housing 31, a crosspiece 50 with a through opening 51 for a cable binder is formed.

The described wire connector in the second embodiment is used, under reference to FIGS. 8 to 10, for generating a connecting splice as follows. First, the cable wires 37 of a cable to be connected are inserted into the guide channels 34 of the left-hand section of the lower part of housing 31, the holding tongues 45 fixing the cable wires 37, and the cable wires 37 being, further, laid over the contact slots of the cutting/clamping contacts 35 of the left-hand row 40 and over the separating knives 36. Subsequently, the upper part of housing 32 represented in the left-hand side of FIG. 8, is latched on, the press-in pieces 42 pressing the cable wires 37 into the contact slots of the cutting/clamping contacts 35, the cutting/clamping contacts 35 engaging into the cross slots 43 of the upper part of housing 32, and, further, the shear-off edge 48 of the upper part of housing 32 cutting the free ends of the cable wires 37, at the separating knives 36, smoothly off. Subsequently, the right-hand upper part of housing 32 is placed on in the same manner, the cable wires 38 of the further cable to be connected being contacted with the cutting/clamping contacts 35 of the right hand row 41, and being, simultaneously, cut off at the separating knives 36. Over the connecting crosspieces 39 of each pair of cutting/-clamping contacts 35, thus, associated pairs of cable wires 37,38 are connected conductively. Several cable connectors can be connected to each other by means of a plastic strip as cable binder being pulled through the through-openings 51 of each lower part of housing 31.

Figure 11:
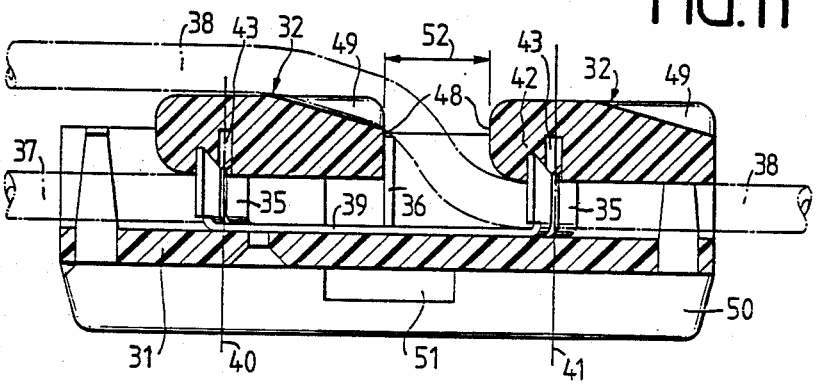
FIG. 11 is a longitudinal sectional view through the wire connector forming a branching splice according to FIG. 8.
Figure 12:
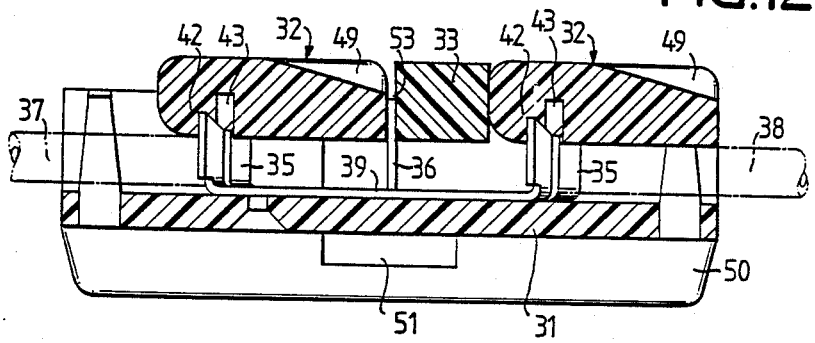
FIG. 12 is a longitudinal sectional view through the wire connector according to FIG. 8 with additionally snapped-on separating element for converting the branching splice into a connecting spice.

In the following, based on FIGS. 11 and 12, the generation of a branching splice with the wire connector in the second embodiment is described in more detail. Here, the cable wires 37 of the cable to be connected are connected in the same way by means of the left-hand cover part 32, as it has been described for generating a connecting splice based on FIGS. 8 to 10. The cable wires 38 of the further cable to be connected are then placed over the left-hand upper part of housing 32 being already snapped-in, said cable wires 38 being guided through the grooves 49 on the upper side of the left-hand upper part of housing 32. The cable wires 38 are, then, conductively connected to the cutting/clamping contacts 35 of the right-hand row 41 by means of the further upper part of housing 32, being, however, in contrast to FIGS. 8 to 10, turned by 180° by its vertical axis, latched with the lower part of housing 31, such that the longitudinal side wall of the right-hand upper part of housing 32 provided with the shear-off edge 48, is arranged spaced to the center row of separating knives 36. In this way, a branching splice is formed, in which the ends of the cable wires 37 are connected electrically to the passing-through cable wires 38.

For generating a by-pass splice, now out of the branching splice again a connecting splice can be formed. For this purpose, into the free space formed by the distance 52 between the two upper parts of housing 32, the separating element 33 is inserted, said separating element 33 being provided with a shear-off edge 53 cooperating with the row of separating knives 36. In this way, the cable wires 38 of the right-hand side can be cut off smoothly, too. The separating element 33 can, in a manner not shown here in detail, be fastened to the upper part of housing 32 by means of a film hinge.

Figure 13:
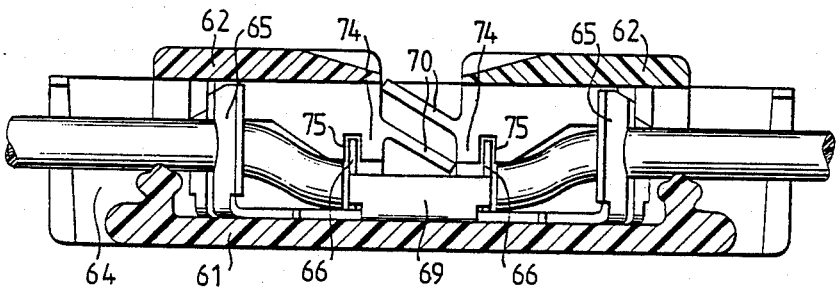
FIG. 13 is a longitudinal sectional view according to FIG. 10 through the wire connector forming a connecting splice in the third embodiment.
Figure 14:
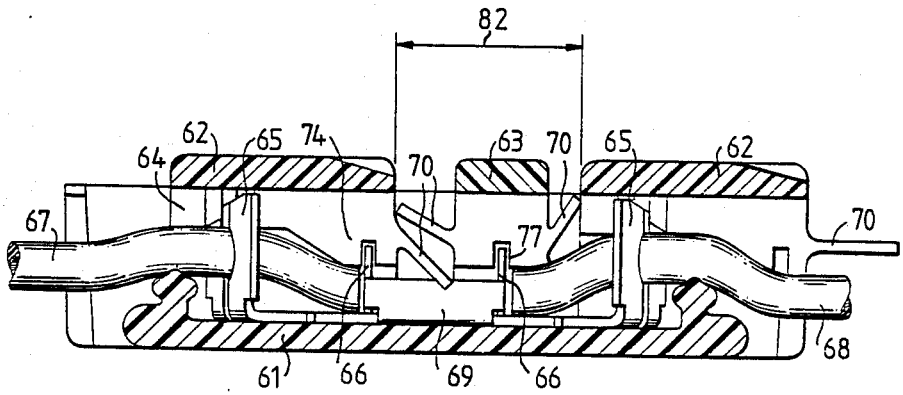
FIG. 14 is a longitudinal sectional view through the wire connector according to FIG. 13.

The wire connector in the third embodiment according to FIGS. 13 and 14 is, in principle, identical to the wire connector in the second embodiment. In contrast hereto, however, in the longitudinal center of the lower part of housing 61, two rows of separating knives 66 are formed, which, in turn, are formed as lugs of one piece together with the crosspieces 69 of the cutting/clamping contacts 65. The cutting/clamping contacts 65 are inserted into the guide channels 64 of the lower part of housing 61. In contrast to the second embodiment, at the undersides of the separating pieces 74 one each separating slot 75 is formed, cooperating with one of the two rows of separating knives 66, in order to separate a cable wire 67,68. Additionally, at the longitudinal side wall assigned to the separating slots 75 of each upper part of housing 62, a spring-elastic cover lug 70 is mounted being formed as one piece with the upper part of housing 62.

FIG. 13 shows the embodiment of a connecting splice, in which the two upper parts of housing 62 each cooperate with their separating slots 75 with the separating knives 66 of the two rows, the spring-elastic lugs 70 closing the free space remaining between the upper parts of housing 62.

In FIG. 14, the wire connector in the third embodiment is shown as resolved branching splice. Here, the upper part of housing 62 shown on the left-hand side is latched on in the same way as the upper part of housing 62 represented in FIG. 13. The upper part shown on the right-hand side of FIG. 14 is, turned by 180° by its vertical axis, latched on the lower part of housing 61, the separating slots 75 not coming into engagement with the right-hand side of separating knives 66. Between the two upper parts of housing 62, there is a larger distance 82, into which the separating element 63 is inserted, said separating element 63 being latched in the same way with the lower part of housing 61 as the upper parts of housing 62. On the underside of the separating element 63, a separation slot 77 is formed, cooperating with the row of separating elements 66 remaining free, in order to cut off, here, a cable 68 first passed-through for forming the connecting splice. The separating element 63, too, is provided with elastic cover lugs 70 being formed on either side of the separating element 63.

While specific embodiments of the invention have been shown and described in detail to illustrate the application of the principles of the invention, it will be understood that the invention may be embodied otherwise without departing from such principles.

What is claimed is:

1. A wire connector for cable wires, comprising: a lower housing part with at least two guide channels for receiving cable wires; at least one upper housing part including snap-in means for forming a snap-in connection between said upper housing part and said lower housing part, said upper housing part forming a snap-in connection with said lower housing part in a first snap-in position with respect to said lower housing part and in a second snap-in position with respect to said lower housing part; at least two cutting/clamping contacts each inserted into respective corresponding said at least two guide channels of said lower housing part, each cutting/clamping contact being provided with contact slots adapted to make contact with a cable wire, said cutting/clamping contacts of the respective corresponding guide channels being each electrically connected to an adjacent one of said cutting/clamping contacts; said upper housing part having an underside with at least two press-in pieces formed at the underside of said upper housing, each of said press-in pieces cooperating with a respective cutting/clamping contact slot to urge one of the cable wires into electrical contact with said cutting/clamping contacts when said upper housing part is connected to said lower housing part in said first snap-in position and said second snap-in position; at least two separating knives each inserted in a respective corresponding one of said at least two guide channels for separating a corresponding one of the cable wires; and, separating means positioned at the underside portion of said upper housing part for urging a cable wire into a separating knife when said upper housing part is in said first snap-in position and maintaining a cable wire out of contact with a separating knife when said upper housing part is in said second snap-in position.

2. A wire connector according to claim 1, wherein: said upper housing part first snap-in position is turned by 180° about a central vertical axis from said upper housing part second snap-in position relative to the lower housing part.

3. A wire connector according to claim 1, wherein: each of said cutting/clamping contacts are formed integral with at least one of the separating knives of a one piece electrically conductive metal material.

4. A wire connector according to claim 1, wherein: said cutting/clamping contacts are each inserted into a respective corresponding guide channel under an angle alpha with respect to the longitudinal axis of said guide channel.

5. A wire connector according to claim 4, wherein: said angle alpha is 30° and 60°.

6. A wire connector according to claim 1, wherein: said cutting/clamping contacts are positioned so as to form an angle alpha with respect to the longitudinal axis of a corresponding guide channel which is opposite to an adjacent cutting/clamping contact forming an opposed angle alpha in an opposite direction from the longitudinal axis of the respective guide channel.

7. A wire connector according to claim 1, wherein: said press-in pieces and said separating means are formed from longitudinal pieces arranged on the underside of said upper housing part, each of the longitudinal pieces being provided approximately on the longitudinal center with slots for engagement of the cutting/clamping contacts and at their ends with slots for engagement of the separating knives.

8. A wire connector according to claim 7, wherein: every second longitudinal piece of the upper housing part is replaced at an end by an elastic portion.

9. A wire connector according to claim 1, further comprising: separating element means for latching with said lower housing part after said upper housing part is snapped into said lower housing part, said separating element means including at least two press-in pieces provided with slots for engagement of respective corresponding separating knives, said press-in pieces of said separating element means being provided for every second guide channel only.

10. A wire connector according to claim 1, wherein: said guide channels are positioned in a longitudinal direction of said lower housing part, said cutting/clamping contacts being positioned in each guide channel arranged in two spaced rows extending laterally of the lower part of the housing, said separating knives including at least one row of separating knives positioned between the two rows of cutting/clamping contacts, said upper housing part including a first upper housing part corresponding to a first row of cutting/clamping contacts and a second upper housing part associated with a second row of cutting/clamping contacts, each of said first and second upper housing parts being latchable with the lower housing part in two different positions above the associated respective row of cutting/clamping contacts.

11. A wire connector according to claim 10, wherein: each of said first and second upper housing parted have a shear-off edge to be positioned adjacent said at least one row of separating knives for pressing a wire cable into an associated separating knife.

12. A wire connector according to claim 11, wherein: said shear-off edge is formed at one longitudinal wall of one of said first and second upper housing parts.

13. A wire connector according to claim 11, further comprising: a shear-off edge formed at a separating element means insertable between a longitudinal side wall of one of said first and second upper housing parts and said at least one row of separating knives.

14. A wire connector according to claim 11, wherein: said separating element means is fastened to a longitudinal side wall of the upper housing part by means of a film hinge.

15. A wire connector according to claim 10, wherein: said separating knives are positioned at a connection crosspiece of said cutting/clamping contacts.

16. A wire connector according to claim 10, wherein: each of said first and second upper housing parts have a groove extending obliquely to a longitudinal wall for guiding branched cable wires.

17. A wire connector according to claim 10, wherein: two spaced rows of separating knives are positioned in said lower housing part laterally to a longitudinal axis of the guide channels between said two rows of cutting/-clamping contacts, said upper housing part having a separating slot to be pressed on the rows of said separating knives.

18. A wire connector according to claim 17, wherein: said separating slot is positioned on the underside of a separating element means which may be placed between said first and second upper housing parts on one of said rows of cutting/clamping contacts.

19. A wire connector according to claim 17, wherein: each of said first and second upper housing parts includes a side wall having a spring-elastic lug assigned to each separating slot.

20. A wire connector according to claim 18, wherein: elastic lugs are positioned on side walls of said separating element.

* * * * *